10/25/83 OR SR 4,411,663

United States Patent [19]

Lauchenauer

[11] 4,411,663

[45] Oct. 25, 1983

[54] REACTABLE REAGENTS WITH SUBSTRATES

[75] Inventor: Alfred E. Lauchenauer, Horn, Switzerland

[73] Assignee: Adnovum AG, Horn, Switzerland

[21] Appl. No.: 285,681

[22] Filed: Jul. 21, 1981

[51] Int. Cl.[3] ..... D06L 3/14; D06L 1/00; D06B 1/04; D06M 1/22

[52] U.S. Cl. ..... 8/107; 8/111; 8/137.5; 8/138; 8/125; 8/149.1; 8/477; 427/373; 427/384

[58] Field of Search ..... 8/107, 477, 149.1, 138, 8/137.5, 111, 125; 427/226, 373, 384

[56] References Cited

U.S. PATENT DOCUMENTS 4,099,913 7/1978 Walter et al. ..... 8/477
4,193,762 3/1980 Namboodri ..... 8/477
4,208,173 6/1980 Gregorian et al. ..... 8/477
4,326,904 4/1982 Eckert et al. ..... 8/477

*Primary Examiner*—Maria Parrish Tungol
*Attorney, Agent, or Firm*—Edwin E. Greigg

[57] ABSTRACT

This invention relates to a method of treating a surface with reagents. The method comprises:

(i) establishing a reagent in a liquid phase;
(ii) forming a foam of said liquid phase;
(iii) applying said foam to said surface to be treated;
(iv) causing or allowing the foam to collapse at the interface of said surface being treated to deposit the reagent thereon and thereafter removing or deactivating the reagent on said surface when the treatment is complete, whereby the rate of foam collapse is controlled to control the rate of application of the reagent to the said surface.

12 Claims, No Drawings

REACTABLE REAGENTS WITH SUBSTRATES

The present invention relates to the reaction of reagents with substrates.

In order to prevent damage caused by overdoses of reagents capable of chemical and/or physico-chemical reaction or interaction with materials or substrates to be treated, such agents usually had to be applied either in a concentration sufficiently low to prevent damage, or stabilised to a degree that permitted the release of only such amounts of reagent that at any given moment the concentration was low enough to prevent damage.

In both cases the result is that the reaction proceeds at a rate which is slow. Where stabilisers have been employed, it has been necessary to adjust the reagent concentration, and these adjustments have been very delicate and an imbalance in the treatment system can arise as a result of variations for example in the temperature, in agents present in the substrate or in the material to be treated itself.

In particular the treatment of substrates formed of woven or natural synthetic fibres or from substrates formed of mats of fibres in random orientation has been slow, and in consequence there is a need for a system which provides for more rapid treatment of such materials, while at the same time safeguarding the material and/or substrate itself against damage.

According to the present invention there is provided a method of treating a surface with reagents which method comprises:

(i) establishing the reagent in the liquid phase;
(ii) forming a foam of said liquid phase;
(iii) apply said foam to said surface to be treated;
(iv) causing or allowing the foam to collapse at the interface with said surface being treated to deposit the reagent thereon; and thereafter removing or deactivating the reagent on said surface when the treatment is complete, whereby the rate of foam collapse is controlled to control the rate of application of the reagent to the surface.

The surface to be treated may be the surface of a substrate having a continuous surface such as a sheet, a filamentary material such as natural or synthetic fibres, a woven material including a knitted material also formed of natural synthetic fibres or a random mat.

The reagent may be any reagent capable of interacting either physically, biologically or chemically with the material of said surface. The reagent is preferably present in an aqueous solution and the concentration of the reagent can be considerably in excess of that hitherto employed since the amount of reagent applied to the material is determined by the volume of the foam with respect to the initial volume of the reagent containing liquid and by the amount of agent released to the substrate by the collapse of the foam, and is not dependent entirely upon the concentration of the reagent in the initial solution prior to foaming.

The collapse of the foam may be caused by heating the interface to a temperature at or above the boiling point of the liquid phase. Alternatively, the collapse of the foam at the interface may be caused by reducing the viscosity of the foam sufficiently to allow the liquid from which it is formed to contact said surface. The rate of collapse of the foam layer may be adjusted to adjust the rate of application of the reagent. Thermodecomposition of the foam by heating of the interface may be effected by the application of, for example, hot air or steam to the reverse side of the material to be treated or by heat transmitted through solid bodies.

Collapse of the foam may also be effected by incorporating within the foam, destabilising agents which serve to reduce the viscosity of the liquid from which the foam is formed.

After completion of the treatment period, the residual reagent of the foam may be removed by washing, i.e. with water.

In a particular embodiment of the present invention highly active systems may be applied to substrates or materials in an easily controllable manner and at very high rates of interaction by controlling not the concentration of the reagent in the treating bath, but the amount of the bath which at any given moment is in contact with the material to be treated.

The bath containing the reagent is applied to the substrate in the form of the foam; the main dosaging factor is the rate of decomposition of the foam layer on the substrate in particular the layer of foam directly in contact with the substrate surface.

In a further aspect of the present invention the process comprises the application in foam form of agents capable of interacting with material of the substrate to the substrate surface and causing the foam layer, in particular the interface foam layer to collapse at the rate desired and to terminate the interaction by removing or rendering inactive said agents where the desired degree of interaction has been achieved.

As stated above, the preferred method for gradually collapsing the interface layer of the foam, i.e. the layer directly in contact with the surface of the substrate is destabilisation of the foam particularly through the application of heat and/or destabilising agents. A particularly suitable form of the process comprises in applying an aqueous system in foam form and applying heat to the substrate preferably from the side opposite to that treated with the foam, to generate temperatures which are higher than the boiling point of water, thus causing the interface layer of the foam to collapse and exposing the surface of the substrate to a new layer of cells of the foam containing agent capable of interacting with said substrate.

In an alternative embodiment of the invention the incremental application of agents capable of interaction of the material of the substrate according to the present invention is achieved by gradually increasing the flow rate of the foam, i.e. by decreasing the viscosity of the foam to a degree which enables it to diffuse in or onto the substrate as a liquid, the rate of diffusion being governed by the rate of collapse of the interface foam layer. In this case, heat may also be applied to the foam coated side of the substrate causing the foam surface to collapse in a gradual and controllable manner. The liquid released by the collapse of the foam layer dilutes the next layer of the foam and thus increases its flow rate by lowering its blow rate thereby resulting in further collapse of the foam so that the liquid thus generated finally diffuses gradually into the substrate at and through the foam substrate interface layer.

The flow rate or flow tendency of any particular foam decreases with the blow rate, i.e. the degree to which the bath has been foamed. The blow rate may be expressed as the ratio between the volume of the foam of the bath and the bath before foaming, that is to say, a blow rate of 20:1 means that the bath has been foamed to twenty times the original volume.

The flow rate or flow tendency may be determined by measuring the volume of the foam flowing through an orifice or tube of defined diameter during a given time, such as, per minute, or by measuring an angle at which a plate which is coated with a foam has to be tilted to start flow of the foam or by other similar methods.

The flow rate or flow tendency of any particular foam will become almost zero at a certain blow rate and will remain at this very low level if the blow rate is increased. Foams with a low or with substantially zero flow rate, will collapse and thus release liquid capable of diffusing into the substrate very slowly unless foam collapse is caused by the method outlined previously, i.e. by thermodestabilisation and collapsing of the interface foam layer by heat applied through the substrate.

An alternative method to that outlined above may be applicable to substrates not permeable to hot air or not easily capable of transmitting heat from the reverse side to the interface with the foam layer. It consists, as described above, in increasing the flow tendency of the foam by gradually releasing liquid from collapsing layers of the foam thus diluting underlying layers of the foam and lowering their blow rate. Some of the liquid released from the collapsing layers of the foam has been found to travel through underlying layers of the foam along walls of foam cells to the interface foam layer and into the substrate providing also the gradual release of agent to and/or into the substrate itself. Liquid applied to the surface of the foam layer, or released by the collapse of the top layers of foam (facing away from the substrate) in this alternative method thus will flow through the foam onto the surface of the substrate, assisted by the lowering of the blow rate of the foam resulting from the flow of liquid.

Thermal decomposition of the interface layer of the foam or of the foam layer per se may be suitable for adjusting the rate of interaction by simply varying the reaction temperature and the foam decomposition speed. The steam released in many cases will benefit the interaction by providing fast heat transfer and thorough penetration.

Thermal decomposition of the interface layer may be assisted or substituted by physico-chemical means conductive to destabilisation of the foam, for example, by foam destabilisation agents (agents increasing surface tension), reducing effectiveness of foaming agents or of foam stabilisers used to produce and/or stabilise the foam per se by agents such as well known in the prior art. Such foam destabilising agents may be present in the substrate to be heated or treated and may be applied to the substrate or to the foam front layer during the interaction period.

The interaction of the agents present in the foam with the substrate or material to be treated may be terminated by removing the foam layer not yet decomposed, by stopping the front layer decomposition of the process and/or by rendering the system inactive. Since in most cases it will be necessary to remove unused reagents, decomposition products of reagents or ancillary agents present in the system, washing or rinsing of the treated material will be the most frequently used method to terminate the interaction.

However, where the bath is applied in the form which contains a mixture of agents capable of achieving different effects in consentive continuous treatments without rinsing between steps, for example, in the boiling off and bleaching with a bath containing alkali and bleaching agent such as for instance hydrogen peroxide, which is followed by a mercerising treatment, it is unnecessary (and undesirable from an economical point of view) to rinse after the alkaline peroxide has boiled off and bleaching preparation has been applied to cellulose-containing textile sheet material. After bleaching has been completed (if desired followed by a steaming treatment), the sheet material is fed into equipment capable of holding or even increasing the dimensions of the sheet material, in particular its width, such as for instance tenter-like equipment, and the concentration of the caustic is increased to mercerising strength and beyond by evaporation through the action of heat, care being taken that the boil-off and bleaching bath contains an amount of alkali hydroxide sufficient for giving a solution of mercerising strength when water is evaporated while the amount of water present in the fabric is still at a level at least equal to 25%, preferably at least 30% of the cellulosic fibre material present in the sheet material. Alternatively, one may apply additional amounts of caustic after bleaching/boiling off is completed (the application of such additional caustic in the form of foam has the advantage of keeping the total amount of water low and thus saves energy in drying).

The caustic may then be removed by neutralising and/or rinsing only after this partial drying.

If mercerising is to be carried out first (followed by boiling off and bleaching), peroxide may be applied to the caustic containing sheet material as an aqueous solution containing virtually no or only small amounts of caustic. Still another variation consists in bleaching and boiling off with a preparation applied according to the invention, holding or increasing the dimensions of the sheet material while water is evaporated to concentrate the caustic, and removing the caustic by rinsing and or neutralising only after a bleaching agent has been applied to and reacted with the sheet material.

Even the action of enzymes with agents to be removed by enzymatic degradation can be carried out by the process according to the present invention at much higher speeds than by conventional methods. Complete removal of starch present in cellulosic textiles as warp sizing material was for instance effected by rinsing after an interaction between an enzyme applied in foamed form to a fabric containing the size in as little as 30 seconds.

In the case of sheet material, for example, the process may be a continuous one comprising the steps of applying a foamed agent to at least one surface of a moving sheet, applying means capable of collapsing the interface or front layer of the foam under conditions as regards rate of foam, decomposition and interaction temperature providing interaction to the degree desired within the interaction period determined by the duration of contact of the foam agent with the substrate while the foam collapsing system is effective, and thereafter terminating the treatment by deactivating the system causing the foam collapse at the foam substrate interface and removing unused reagents and reagent decomposition by rinsing.

In the case of sheet material such as films, fabrics treated in a continuous process, dyeing formulations may be applied by the method of the invention. If the sheet material contains or consists of cellulosic fibres, desizing, boiling off (removal of wax and other impurities present in the surface of the natural cellulosic fibres), bleaching and even mercerising (or other caustic treatments) may be carried out.

In the case of other textile sheet material such as synthetic fibres, wool and blends, removal of sizes, scouring the removal of impurities from the fibrous material, the interaction of the fibres with strong swelling agents, the interaction of wool fibres with agents reducing the felting tendency of wool chemical or by in situ reactions, interfacial polymerisations, the interaction of fibres or fibre surfaces with agents capable of grafting, chain degradation or substitution reactions or with agents causing crosslinking of macromolecular chains (cellulosic, proteninic or synthetic) by the formation of covalent or hydrogen bonds or other forces enhancing intermolecular cohesion, may be effected using the process in accordance with the present invention.

By the term "sheet material" there is to be understood not only coherent sheets such as plastic, metal or wood or paper, fabrics, woven, non-woven or knitted, but also particulate or fibrous material treated in a form of sheets, for example, materials arranged in the form of a thin layer carried on or supported by a conveyor belt or like structure, preferably permeable to liquids and air. Webs consisting of loose fibres, slivers, rovings, and card webs are examples of such sheet materials consisting of a multitude of essentially unbonded elements arranged and treated in the form of a sheet.

Webs of loose cotton fibres for example may be boiled off, cleaned for the removal of dust, cotton seeds, wax, etc. and bleached in sheet form according to the present invention.

Material may be treated according to the present invention in filamentary form, the filamentary material being treated either as single strands or as a multitude of strands travelling on parallel courses.

The foam itself may be generated by blowing compressed air through a tube which carries a porous plate at an outlet end thereof, the tube being immersed in a bath of the reagent. The blow rate of the foam is dependent upon the foaming characteristics of the original bath.

Following is a description by way of example only of methods of carrying the invention into effect.

EXAMPLE 1

A cotton fabric in grey state (33 picks and 20 ends per centimeter, yarn count Ne 12 for the warp, 16 for the filling, weight 270 grams per square meter) was treated as follows:

A boil-off and desizing formulation containing:

80 grams per liter sodium hydrotide 7 grams per liter boil-off agent 1 gram per liter wetting agent (aliphatic phosphoric acid ester)

10 grams per liter washing agent (alkyl sulphate)

was turned into a foam by blowing compressed air through a tube which carried a porous plate (filtering plate G3), which plate was submersed in the bath. The resulting foam had a volume twenty times that of the liquid before foaming (blow ratio 20 to 1), the average cell diameter of the foam was below 0.08 centimeters, and the pot life of the foam was 20 minutes (time of complete collapse of the foam stored in a beaker at room temperature).

This foam was applied to one surface of the fabric in a layer 2 centimeters thick. To cause collapse of the foam at the foam fabric interface, the side of the fabric not treated with foam was brought into contact with a metal surface having a temperature of 300° C. for 40 seconds (interaction time). During this period interface layers of foam were destroyed consecutively, the foam sheet previously applied to the fabric thus gradually collapsing from bottom to top, exposing fresh layers of foamed reagent with the collapse of each interface foam layer. After 40 seconds the fabric was rinsed to remove unused reagent and the other agents present in the bath.

The heavy cotton fabric was found to be uniformly (i.e. all over and all through) desized, all cotton seeds were removed and a marked lightening of the shade was observed (i.e. wax and coloured impurities had been removed by the treatment). No damage caused by the treatment could be detected, the textile strength was virtually the same as before the treatment, and the degree of polymerisation was 2550 (determination according to Swiss National Standard Method 195'598).

EXAMPLE 2

The same fabric as in Example 1 was treated with the same bath, the only difference being that collapse of interface foam layers was effected by convection of hot air and radiation emanating from a metal plate temperature 300° C. arranged in a plane parallel to the plane of the fabric at a distance of 0.5 centimeters underneath the fabric. The interaction time was 60 seconds, the after treatment and the effects produced were identical to those of Example 1.

EXAMPLE 3

The treatment of Example 1 was repeated, but foam collapse was effected by blowing hot air (temperature 290° C.) against the foam layer previously applied to the fabric, the foam thus being pressed against the fabric. Interaction time was 8 seconds. Immediately after stopping the flow of hot air, the fabric was washed out, neutralized and rinsed. All the size present on the warp yards of the fabric and all cotton seeds present in the fabric were removed. Mechanical properties were not affected.

The same results were obtained when foam collapse was effected by irradiation of the foam-coated fabric with infra-red radiation.

EXAMPLE 4

The treatment of Example 1 was repeated with a light weight cotton sateen (grey state, 68/45 yarns centimeter, yarn count Ne 46/42, weight 90 grams/square meter. The formation was the same as in Example 1, the thickness of the foam layer was 0.5 centimeters.

Complete removal of the size present and of cotton seeds was observed, no damage to the tensile strength or to the degree of polymerisation could be found.

EXAMPLE 5

The fabric described in Example 1 was bleached with a foam unstabilised protide bleaching bath of the following composition:

45 ml per liter hydrogen protide (40% strength)

4 ml liter wetting agent (same as in Example 1)

6 grams per liter sodium hydrotide.

The bleaching treatment was applied to the fabric after desizing and boiling off according to Example 1. The bath was turned into a foam (degree of foaming 20:1) as described in Example 1, and applied in foamed form to one side of the fabric in a thickness of 2 centimeters. Interface foam collapse was effected by contact heat as described in Example 1, the time of interaction being 40 seconds.

The bleaching effect obtained was about identical to effects produced by conventional protide bleaching with much longer reaction times (whiteness 67.00% against 55.8 before the treatment). No tensile strength or degree of polymerisation damage could be found.

Identical effects were obtained if foam collapse was effected as described in Examples 2 and 3.

EXAMPLE 6

The fabric described in Example 1 was in one step desized, boiled off and bleached, using the following procedure.

Bath Composition:

40 grams per liter sodium hydrotide 8 grams per liter wetting agent (same as in Example 1)

45 ml per liter hydrogen protide (40%)

10 ml per liter washing agent (same as in Example 1)

This bath was foamed and applied to the grey fabric as described in Example 1 (degree of foaming 20:1, foam layer thickness 2 centimeters). Interface foam collapse was effected as described in Example 1, the time of Internation being 40 seconds.

Effects obtained: Whiteness equal to conventional bleaching effects, good wettability, removal of most of the size, no loss of tensile strength, degree of polymerisation higher than 2350.

Identical effects were obtained with the same bath applied under the conditions described in Examples 2 and 3.

EXAMPLE 7

When a cotton sateen described in Example 4 was treated with the bath of Example 6, the conditions of the treatment otherwise being those of Example 4, complete desizing, complete removal of seeds and excellent wettability were obtained.

EXAMPLE 8

The combination treatment described in Examples 6 and 7 applied to a cotton card web carried on fine-mesh stainless steel wire net.

Removal of the agents after the interaction period was effected by applying a coating of foamed washing neutralising solution (blow ratio 1:30, bath containing 10 grams per liter of acetic acid and 3 grams per liter of sandozin N1 (non-anionic wetting agent), thickness of foam layer 5 centimeters and sucking the foam through the web by means of vacuum slots arranged underneath the wire net conveyor belt. The treatment was treated twice with a foamed washing solution containing 1 gram/liter of a non-ionic foaming agent (sandozin N1, sandoz), total layer thickness 10 centimeters, blow rate 10:1.

Practically complete removal of cotton seeds, a bleaching effect sufficiently high to print or to dye the material (dyeing in medium to deep shades) after spinning and weaving, good wettability and a dust content of practically zero were obtained. Due to the use of foamed washing solution the amount of water remaining in the fibre material was found to be very low (less than half of what the same web retained when it was wetted in the same bath (unfoamed) and squeezed in a mangle). Drying thus was at least twice as fast.

The neutralizing and the washing baths were foamed in one example as described in Example 1, in another test by means of passing the bath through a commercially available continuous foamer (manufactured by Bombi, Settimello, Italy). Additional tests showed that the bleaching and boiling off baths used in previous examples could also be foamed in the continuous foamer.

A cotton print cloth (120 grams per square meter) containing a starch size in grey state was coated with a foamed enzymatic desizing preparation containing per liter 25 milliliters of Rupidase and 2 milliliters of a non-ionic wetting agent (sandozin NIT). The foaming degree was 1:40. The fabric thus coated was subjected to a heat treatment consisting of guiding the fabric at a distance of 4 milliliters over a hot metal plate having a temperature of 300 centigrade degrees. The action of heat lasting 30 seconds. After the fabric was rinsed hot and cold, no starch could any longer be detected on the fabric.

I claim:

1. In a process for treating a sheet of a web surface material with reagents, which method comprises:

establishing a reagent in a liquid phase;

forming a foam of said liquid phase;

applying said foam to said web surface to be treated;

causing a portion of the foam to collapse and deposit said reagent on said web surface;

the improvement which comprises establishing a temperature gradient through the web surface into said foam applied thereto, thereby causing a collapse of the foam substantially only at the foam/surface interface, at ambient pressure, whereby the reagent application rate to said web surface is determined by the proportion of the foam which collapses, and immediately terminating any interaction between the foam and the web surface.

2. A method as claimed in claim 1, wherein the surface is the surface of a substrate having a continuous surface, a filamentary material, a woven material or a random mat.

3. A method as claimed in claim 1 wherein the reagent is a reagent capable of interacting either physically, biologically or chemically with the material.

4. A method as claimed in claim 3, wherein the collapse of the foam is caused by heating the web surface remote from the surface carrying the foam, whereby the interface between the foam and the web surface reaches a temperature of at least the boiling point of the liquid phase, thereby controlling the rate of application of the reagent to the web surface.

5. A method as claimed in claim 1, wherein the reagent from which the foam is formed includes an enzyme for treatment of the web surface.

6. A method as claimed in claim 1 wherein the foam is generated by blowing compressed air through a tube having a porous plate at the outlet thereof said tube being immersed in a bath of said reagent to be foamed.

7. A method as claimed in claim 1, wherein the termination of the interaction between the foamed reagents and the web surface is terminated by terminating decomposition of the foam at said foam/surface interface by cooling.

8. A method as claimed in claim 1, wherein the termination of the interaction between the foamed reagents and the web surface is terminated by removing any remaining foam layer from the web surface.

9. A method as claimed in claim 8, wherein the foam is formed from a bath which contains a mixture of agents capable of achieving different effects in consecutive continuous treatments without rinsing between said steps.

10. A method as claimed in claim 9, wherein the treatment is a boiling off and bleaching treatment whereby a foam is formed of a bath containing alkali and bleaching agent and thereafter mercerizing whereby after bleaching has been completed the treated sheet material is fed into equipment capable of maintaining or increasing the dimensions of the sheet and further foam is applied whereby the concentration of alkali is increased to mercerizing strength and beyond, the foam being collapsed by the application of heat and after contact with said foam, continuing to apply heat to evaporate water deposited therein after collapse of the foam whereby the amount of water present in the fabric after treatment is equal to at least 25% of the cellulosic fibre content present in the sheet material.

11. A method as claimed in claim 1 wherein the reagent from which the foam is formed includes an enzyme for the treatment of the web surface.

12. A method as claimed in claim 1 wherein the foam is generated by blowing compressed air through a tube having a porous plate at the outlet thereof, said tube being immersed in a bath of reagent to be foamed.

* * * * *